US007011572B2

(12) United States Patent
Johnson et al.

(10) Patent No.: US 7,011,572 B2
(45) Date of Patent: Mar. 14, 2006

(54) SCOURING PAD

(75) Inventors: Bryan Johnson, Beauvais (FR); René Catrisse, Beauvais (FR)

(73) Assignee: Financiere Elysees Balzac, Paris (FR)

( * ) Notice: Subject to any disclaimer, the term of this patent is extended or adjusted under 35 U.S.C. 154(b) by 86 days.

(21) Appl. No.: 10/312,265

(22) PCT Filed: Jun. 27, 2001

(86) PCT No.: PCT/FR01/02031

§ 371 (c)(1),
(2), (4) Date: Dec. 23, 2002

(87) PCT Pub. No.: WO02/00090

PCT Pub. Date: Jan. 3, 2002

(65) Prior Publication Data

US 2003/0104776 A1 Jun. 5, 2003

(30) Foreign Application Priority Data

Jun. 30, 2000 (FR) ..... 00 08466

(51) Int. Cl.
*B24B 9/02* (2006.01)

(52) U.S. Cl. ..... 451/466; 451/523; 451/524; 451/526; 451/539; 15/229.11; 15/229.12; 15/229.13; 15/229.14

(58) Field of Classification Search ..... 451/466, 451/523, 524, 526, 539; 15/229.11, 229.12, 15/229.13, 229.14
See application file for complete search history.

(56) References Cited

U.S. PATENT DOCUMENTS

| | | | | |
|---|---|---|---|---|
| 1,851,237 A | * | 3/1932 | Bradford, Jr. | 15/229.11 |
| 1,991,023 A | * | 2/1935 | Mayer | 15/229.12 |
| 3,241,171 A | * | 3/1966 | Benjamin et al. | 15/118 |
| 5,214,820 A | * | 6/1993 | Shumway et al. | 15/118 |
| 5,937,472 A | | 8/1999 | Girardot et al. | |

FOREIGN PATENT DOCUMENTS

| | | |
|---|---|---|
| DE | 298 22 301 U1 | 12/1998 |
| FR | 39331 | 5/1930 |

* cited by examiner

*Primary Examiner*—Joseph J. Hail, III
*Assistant Examiner*—Shantese L. McDonald
(74) *Attorney, Agent, or Firm*—Sutherland Asbill & Brennan, LLP

(57) ABSTRACT

The scouring pad comprises a wad (10) of looped scouring wire. The wad is constituted by substantially concentric windings of the wire (12) such that it presents substantially the form of a toroidal ring. The pad has means for holding the windings together, said means comprising at least one binding strap (20) going around a section of the ring and disposed substantially on a meridian of the torus formed by the ring.

15 Claims, 2 Drawing Sheets

SCOURING PAD

TECHNICAL FIELD

The present invention relates to a scouring pad comprising a wad of looped scouring wire.

BACKGROUND OF THE INVENTION

Scouring pads are known, in particular those made of stainless steel wire of thickness lying in the range 0.01 millimeters (mm) to 0.5 mm, and preferably being about 0.025 mm. The wire is looped, with the loops being formed, for example, by helically-shaped turns. To form the pad, the wire is rolled up so as to constitute a wad. The loops of the wire catch on one another so as to give the wad a degree of cohesion while also conferring a cellular structure thereto (low density). The loops also form scouring surfaces that are needed to make the pad effective, for example in order to scour utensils such as dishes or pans.

By way of example, the wire is calendared between two cylinders which give it a flat section of given thickness; it is then pulled tight over a sharp edge and, while in this situation, it is moved rapidly so as to form the helical loops, as by a spring effect. Scouring pads of that type are very effective for scouring. Nevertheless, after a certain amount of use, the wad tends to come undone, i.e. it tends to lose its uniformity. The loops that serve for scouring purposes tend to separate from one another and to become flattened. As a result the pad loses some of its effectiveness and it is less agreeable to use.

An object of the present invention is to remedy those drawbacks by proposing a pad of the above-specified type in which the wad retains its cohesion for longer.

SUMMARY OF THE INVENTION

This object is achieved by the fact that the wad is constituted by substantially concentric windings of the wire such that said wad is substantially in the form of a toroidal ring, and by the fact that it has means for holding said windings relative to one another, said means comprising at least one binding strap around a section of the ring occupying substantially a meridian of the torus formed by the ring.

The wad is thus made in very simple manner and the loops retain their primary functions (holding the windings together, cellular structure, scouring).

The wire windings are held relative to one another by the presence of at least one binding strap. The strap extends along a meridian of the torus formed by the ring, i.e. it extends substantially radially and it is clamped around a section of the wad that is defined between its inner periphery (empty center) and its outer periphery.

On this section disposed substantially along a meridian, the strap is placed around the windings of the wire and thus holds them relative to one another. However, the binding strap is preferably of small extent, and those regions of the wad that are not situated beneath the strap retain their cellular structure because of the spring effect of the loops against one another, and the effectiveness of the scouring effect of the wad is not affected in any way by the presence of the binding strap.

Beneath the strap, the windings are pressed against one another. Thus, at least in the vicinity of the strap, the windings remain connected together. The loops have less tendency to flatten and separate.

The pad preferably has a plurality of binding straps placed around a plurality of sections of the ring, which sections are spaced apart at substantially regular intervals.

The presence of a plurality of binding straps is particularly advantageous. In the region of a binding strap, the wire windings remain pressed against one another. Even if the loops do become somewhat separated from one another on going away from a strap, the wad does not lose its cohesion because of the presence of the following binding strap. For example, it is advantageous for the wad to comprise four binding straps spaced apart from one another at intervals of about 90°, or three straps spaced at about 120°.

In a particularly advantageous disposition, the pad has a plurality of binding straps together with a linking insert which is placed at the center of the ring and which has the binding straps fixed thereto.

The linking insert is placed so as to take advantage of the initially empty center of the wad. It forms a support for the binding straps which are connected thereto. It also prevents the hole in the wad collapsing.

The pad advantageously also comprises a handle member.

This enables the user to handle the pad via said handle member rather than taking hold of the wire windings directly in the hand.

Advantageously, the handle member is secured to the wad via its central region.

Under such circumstances, the fixing between the handle member and the wad also takes advantage of the empty center of the wad.

Thus, advantageously, the handle member comprises two end portions which meet in the center of the ring and which are fixed to each other, or if present, to the linking insert.

For example, the two end portions of the handle member may be fixed together by snap-fastening or the like, thus avoiding any need to use an adhesive or the like which would run the risk of ceasing to be effective after the scouring pad has been used a few times.

BRIEF DESCRIPTION OF THE DRAWING

The invention will be well understood and its advantages will appear better on reading the following detailed description of embodiments given as non-limiting examples. The description refers to the accompanying drawings, in which.

DETAILED DESCRIPTION OF THE INVENTION

Figure 1:
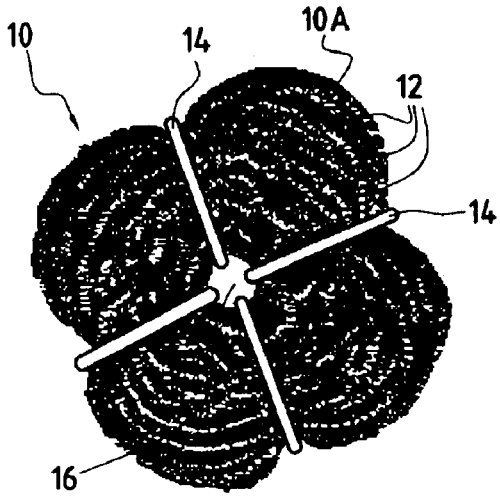
FIG. 1 is a diagrammatic outside view of a first embodiment of the pad in accordance with the invention.

The scouring pad of FIG. 1 comprises a wad 10 made up of windings 12 of looped wire. The loops of the wire cause the windings to catch one with another and, by a spring effect, they give the wad a cellular structure. The windings are substantially concentric so that the wad is substantially in the form of a toroidal ring presenting an empty center (throat of the torus).

The pad has a plurality of binding straps 14 which bind together the wire windings over substantially radial sections of the ring constituted by the wad. These straps 14 lie substantially on the meridians of the torus formed by the wad and the sections that they hold together are defined between the empty center 16 of the wad and its outer periphery 10A.

In FIG. 1, four straps 14 are present that are spaced apart at approximately 90°. It can be seen that the binding effect they have on the wire windings is very localized and that the wad conserves, overall, an essentially cellular structure. Even the loops close to the binding strap serve to space the windings apart from one another while nevertheless holding them together.

For example, the wire from which the wad is made is a stainless steel wire of very small thickness, lying in the range 0.02 mm to 0.03 mm, and of flat section, with the width of the wire being about 0.4 mm to 0.5 mm. The loops may be helical in shape and they may be obtained as described above.

The binding straps may be made of a plastics material or of any other material that presents the required ability to withstand wear. As shown in FIG. 1, the straps need not be connected to one another. Each strap is rolled up and its free ends are fixed together, e.g. by being knotted, welded, or the like.

Figure 2:
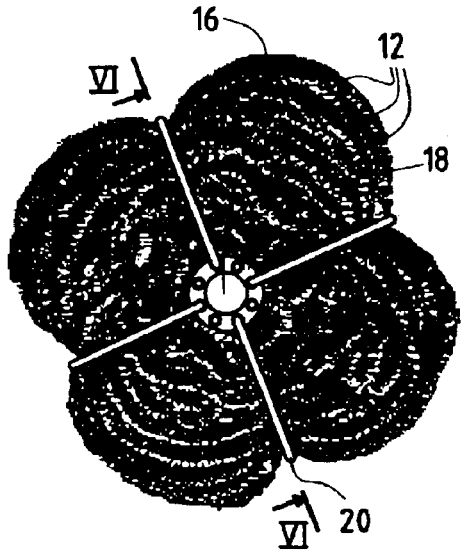
FIG. 2 is a view analogous to FIG. 1 showing a second embodiment using a linking insert for the binding straps.

In the embodiment of FIG. 2, the pad has a linking insert 18 placed in its empty central region 16. The binding straps 20 of FIG. 2 are disposed in the same manner as the straps 14 of FIG. 1, but they are also fixed to the insert 18.

Figure 3:
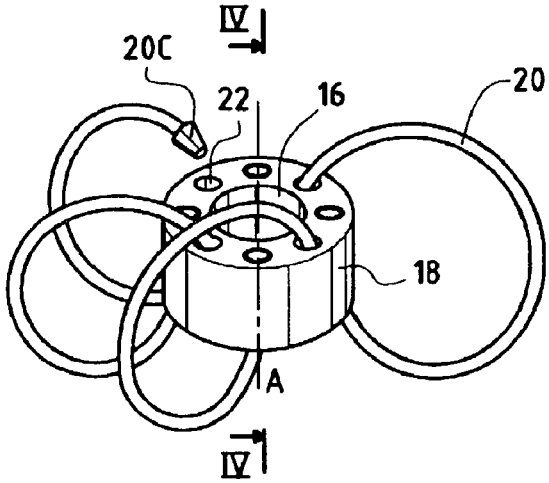
FIG. 3 is a perspective view showing how the linking insert and the binding strap are assembled together.
Figure 4:
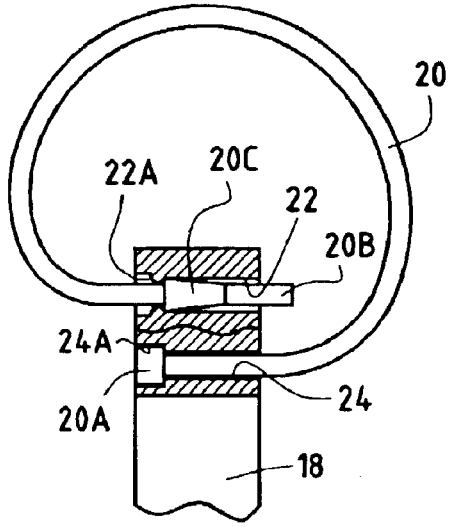
FIG. 4 is a fragmentary cross-section view on a plane defined by line IV—IV of FIG. 3.

As can be seen more clearly in FIGS. 3 and 4, the linking insert presents substantially axial boreholes 22, i.e. holes that extend substantially parallel to the winding axis A of the wire winding forming the ring that constitutes the wad. The first end 20A of the strap 20 in FIG. 4 is fixed to the insert 18, with this strap then being rolled up and extending radially outwards away from the insert 18 until its second end 20B is engaged in the borehole 22 and is retained therein. More precisely, the second end 20B has a retaining head 20C which is engaged in the borehole 22 and which is held therein by a retaining zone 22A formed in the borehole 22, e.g. by a bead. The retaining means 22A and 20C thus co-operate by snap-fastening with the head 20C being engaged by force into the borehole 22 until it has gone past the bead 22A.

The first end 20A of the strap 20 is fixed to the insert 18 by any appropriate means. By way of example, and as shown in FIG. 4, the insert 18 presents a borehole 24 for fixing the first end 20A of the strap 20. This borehole 24 has a shoulder 24A and the first end 20A of the strap 20 presents a retaining head which comes into abutment against the shoulder.

To put the strap 20 into place, the wire constituting the strap is engaged through the borehole 24 until its head 20A comes into abutment against the shoulder. The various straps 20 shown in FIG. 3 are all initially put into place in this manner. Once in this situation, the insert is placed in the empty center 16 of a wad of scouring wire, and each strap 20 is placed around a section of the wad until its second end 20B engages in a borehole 22. The second end 20B of the strap 20 is pulled until its retaining head is retained by the bead 22A.

Provision can be made for the second end 20B to present a plurality of retaining heads 20C that are spaced apart from one another so as to provide a plurality of retaining positions.

The end portion of the strap which projects beyond the borehole 22 in the insert can be cut off.

Figure 5:
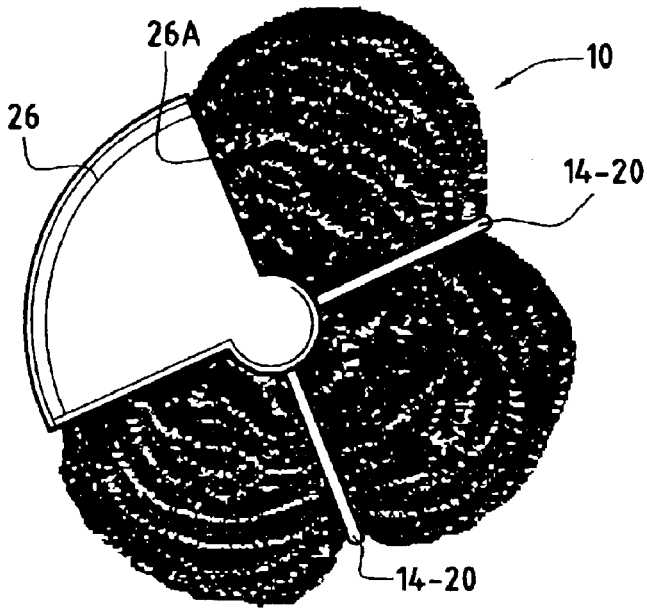
FIG. 5 is a view analogous to FIGS. 1 and 2 for another embodiment in which the pad includes a handle member.
Figure 6:
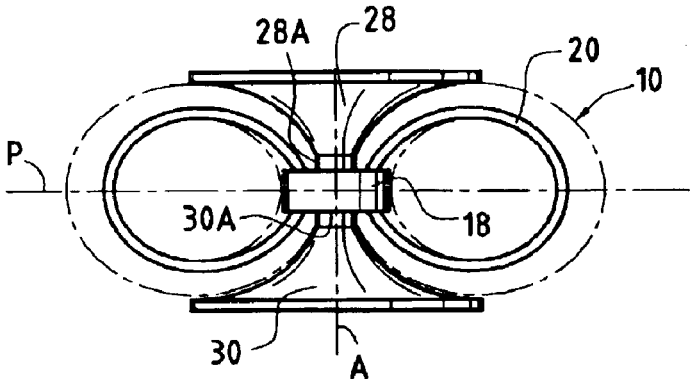
FIGS. 6 and 7 are two cross-section views in a plane corresponding to plane VI—VI of FIG. 2, showing two variant handle members.
Figure 7:
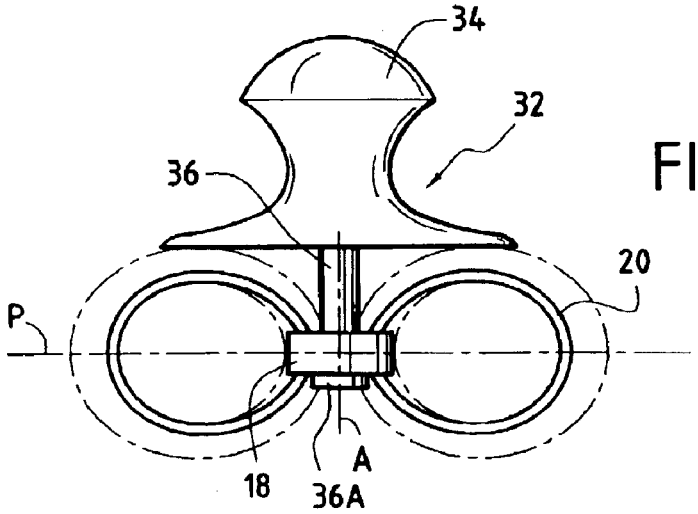

FIGS. 5 to 7 show a scouring pad which further comprises a handle member. In FIG. 5, there can be seen the wad 10 and two binding straps 14. The handle member 26 is placed in such a manner as to occupy an angular sector of the wad. In reality, the wad has four binding straps, and the handle member 26 forms a shell covering the two straps that are not shown in FIG. 5, i.e. a shell that extends over an angular sector of about 90°. This shell thus covers both faces of the wad and the two inside ends 26A of the shell meet in the empty center of the ring formed by the wad where they are fixed together. The embodiment shown in FIG. 5 is compatible with both of the embodiments shown in FIGS. 1 and 2, and that is why the binding straps are referenced both 14 and 20 in FIG. 5.

FIG. 6 shows a variant in a section view and there can be seen two binding straps 20 fixed to a linking insert 18. The outline of the wad 10 is represented by a chain-dotted line.

In FIG. 6, the handle member comprises two shells 28 and 30 which are disposed on opposite sides of the ring about a plane P extending substantially transversely to the axis A thereof. These two shells are in the form of cones whose vertices 28A and 30A meet in the center of the ring. These two shells are then fixed together via their vertices which are snap-fastened one in the other, for example. In FIG. 6, the vertices of the shells pass through the linking insert 18. Nevertheless, this variant of the handle member is also compatible with the embodiment shown in FIG. 1 which does not have a linking insert.

In FIG. 5 as in FIG. 6, the handle member is held by being gripped between the thumb and the index finger, for example.

FIG. 7 shows another variant in which the handle member 32 comprises a knob 34 disposed on one side of the ring relative to the plane P that extends substantially transversely to its axis A. Specifically, this knob is fixed to the wad by a rod 36 which extends through the central region of the ring and which is retained in the linking insert 18.

The handle member 32 may be fixed by snap-fastening, with the rod 36 being snap-fastened in the insert 18, for example, or it may present a simple retaining head 36A which is retained in the insert 18 while the end of the rod remote from said head is snap-fastened inside the knob 34.

The handle members 26, 28, and 30 of FIGS. 5 and 6 could also be fixed to the linking insert 18 if such an insert is present.

What is claimed is:

1. A scouring pad comprising a wad of looped scouring wire, said wad being constituted by substantially concentric windings of the wire such that said wad is substantially in the form of a toroidal ring, the pad having means for holding said windings relative to one another, said means comprising a plurality of binding straps around sections of the ring occupying substantially meridians of the torus formed by the ring and a linking insert which is disposed in the center of the ring and which has the binding straps fixed thereto.

2. A pad as claimed in claim 1, wherein the plurality of binding straps around sections of the ring are spaced apart at substantially regular intervals.

3. A pad as claimed in claim 1, wherein the linking insert presents substantially axial boreholes, each binding strap presenting a first end fixed to the linking insert, being wound around a section of the ring, and presenting a second end which is engaged in a borehole of the linking inset and is retained therein.

4. A pad as claimed in claim 3, wherein the second end of a binding strap has a retaining head co-operating with a retaining zone formed in a borehole.

5. A pad as claimed in claim 1, further including a handle member.

6. A pad as claimed in claim 5, wherein the handle member is secured to the wad via a central region thereof.

7. A pad as claimed in claim 1, further including a handle member that comprises two shells placed on opposite sides of the ring about a plane extending substantially transversely to said ring.

8. A pad as claimed in claim 1, wherein the loops of the wire are formed by helical turns.

9. A scouring pad comprising a wad of looped scouring wire, said wad being constituted by substantially concentric windings of the wire such that said wad is substantially in the form of a toroidal ring, the pad having means for holding said windings relative to one another, said means comprising at least one binding strap around a section of the ring occupying substantially a meridian of the torus formed by the ring, the pad further including a handle member which comprises two end portions meeting at a center of the ring and fixed to each other.

10. A scouring pad comprising a wad of looped scouring wire; said wad being constituted by substantially concentric windings of the wire such that said wad is substantially in the form of a toroidal ring, the pad having means for holding said windings relative to one another, said means comprising at least one binding strap around a section of the ring occupying substantially a meridian of the torus formed by the ring, the pad further including a linking insert which is disposed in the center of the ring and which has the binding strap fixed thereto and a handle member that is fixed to the linking insert.

11. A scouring pad comprising a wad of looped scouring wire, said wad being constituted by substantially concentric windings of the wire such that said wad is substantially in the form of a toroidal ring, the pad having means for holding said windings relative to one another, said means comprising at least one binding strap around a section of the ring occupying substantially a meridian of the torus formed by the ring, further including a handle member that is fixed by snap-fastening.

12. A scouring pad comprising a wad of looped scouring wire, said wad being constituted by substantially concentric windings of the wire such that said wad is substantially in the form of a toroidal ring, the pad having means for holding said windings relative to one another, said means comprising at least one binding strap around a section of the ring occupying substantially a meridian of the torus formed by the ring, further including a handle member that covers an angular sector of the ring.

13. A scouring pad comprising a wad of looped scouring wire, said wad being constituted by substantially concentric windings of the wire such that said wad is substantially in the form of a toroidal ring, the pad having means for holding said windings relative to one another, said means comprising at least one binding strap around a section of the ring occupying substantially a meridian of the torus formed by the ring, further including a handle member that comprises a knob placed on one side of the ring relative to a plane extending substantially transversely to an axis of said ring.

14. A scouring pad, comprising:

a wad of looped scouring wire;

said wad comprising substantially concentric windings of the wire such that said wad is substantially in the form of a toroidal ring; and means for holding said windings relative to one another;

said means comprising at least one binding strap positioned around a meridian of the ring and a linking insert that has said at least one binding strap fixed thereto.

15. A scouring pad, comprising:

a plurality of concentric windings of looped scouring wires;

said plurality of concentric windings comprising a toroidal ring;

at least one binding strap for holding said windings relative to one another positioned about a meridian of said toroidal ring; and a linking insert that has said at least one binding strap fixed thereto.

* * * * *